United States Patent [19]

Dunham et al.

[11] Patent Number: 4,512,553

[45] Date of Patent: Apr. 23, 1985

[54] JACK-UP UNIT

[75] Inventors: David A. Dunham, New Orleans; Robert P. Riggs, Luling; Rufus L. Burton, Jr., New Iberia, all of La.

[73] Assignee: Red Fox Industries, Inc., New Iberia, La.

[21] Appl. No.: 358,920

[22] Filed: Mar. 17, 1982

[51] Int. Cl.[3] ..... B66F 7/12

[52] U.S. Cl. ..... 254/89 R; 254/95

[58] Field of Search ..... 254/89 R, 95, 105–111; 405/196–199, 202

[56] References Cited

U.S. PATENT DOCUMENTS

| | | |
|---|---|---|
| 103,899 | 6/1870 | Lewis . |
| 2,308,743 | 1/1943 | Bulkley et al. . |
| 2,862,738 | 12/1958 | Bayley . |
| 2,924,077 | 2/1960 | LeTourneau . |
| 2,954,676 | 10/1960 | Guy et al. . |
| 2,979,911 | 4/1961 | Sutton . |
| 3,014,346 | 12/1961 | Small . |
| 3,044,269 | 7/1962 | LeTourneau . |
| 3,109,289 | 11/1963 | Roussel . |
| 3,171,259 | 3/1965 | Roussel . |
| 3,183,676 | 5/1965 | LeTourneau . |
| 3,201,945 | 8/1965 | Sutton . |
| 3,245,658 | 4/1966 | Sutton . |
| 3,282,565 | 11/1966 | Sutton . |
| 3,290,007 | 12/1966 | Yielding . |
| 3,332,663 | 7/1967 | Cargile, Jr. . |
| 3,343,371 | 9/1967 | Heitkamp . |
| 3,495,806 | 2/1970 | Sutton . |
| 3,517,910 | 6/1970 | Sutton et al. . |
| 3,604,683 | 9/1971 | Sutton . |
| 3,606,251 | 9/1971 | Willke et al. . |
| 3,722,863 | 3/1973 | Itoh . |
| 3,743,247 | 7/1973 | Willke et al. . |
| 3,804,369 | 4/1974 | Sutton . |
| 4,007,914 | 2/1977 | Sutton . |
| 4,160,538 | 7/1979 | Armstrong . |
| 4,203,576 | 5/1980 | Sutton . |
| 4,269,543 | 5/1981 | Goldman . |

OTHER PUBLICATIONS

"Elevating Work-Over Barge", Drawing No. I-7-7-H12, Aug. 3, 1977, Johnson and Krog, Inc.

"Mallard Rig 35", Drawing No. 17-79-H1, Jun. 79, Penn Engineering, Inc.

*Primary Examiner*—Robert C. Watson

*Attorney, Agent, or Firm*—Guy E. Matthews

[57] ABSTRACT

A jack-up unit for use in a body of water, said unit comprising a floatable hull, a plurality of legs, said legs being suitable for contacting a solid surface and for supporting said hull in an elevated position relative to the surface of said body of water, each of said legs including at least one longitudinally extending leg gear rack, means for moving said hull longitudinally relative to said legs for establishing said hull at a desired height relative to said legs, a guidance system on each leg comprising an upper guide member configurative around said leg at a close tolerance interval and a lower guide member configurative around said leg at a close tolerance level, and a plurality of gear rack sections located one proximate each leg intermediate said upper guide member and said lower guide member, each gear rack section moveable into and out of toothed engagement with said leg gear rack section on its respective leg, said toothed engagement including a gear tooth backlash in excess of said close tolerance between said upper and lower guide member and said leg whereby said engagement of said gear rack section and said leg gear rack is vertically load bearing yet horizontally pliable.

5 Claims, 14 Drawing Figures

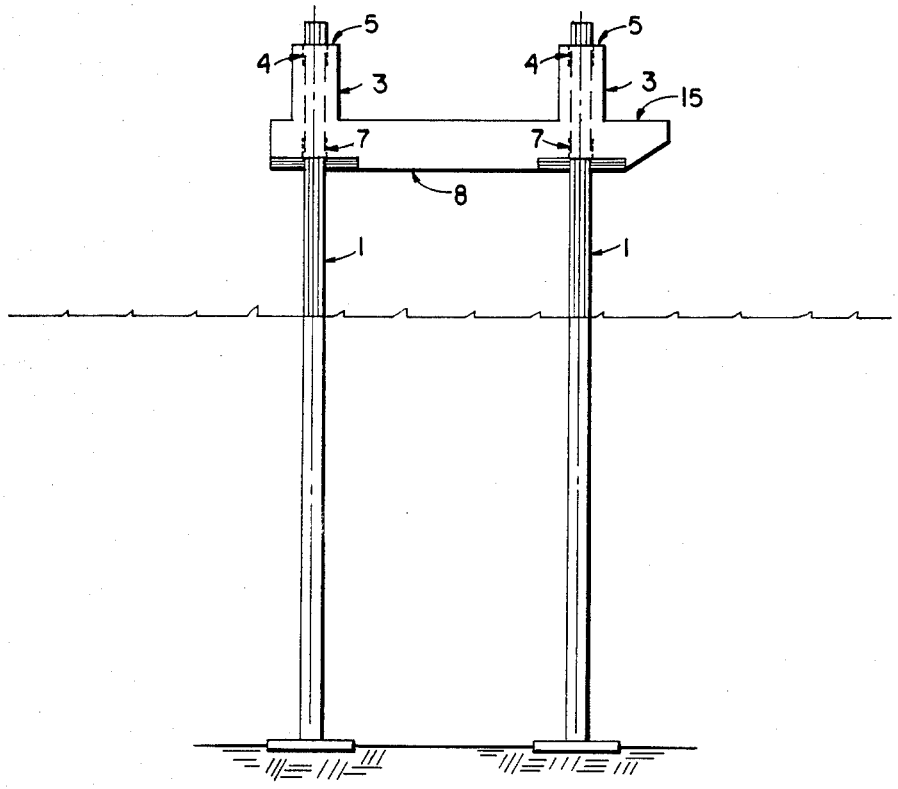
FIGURE 8
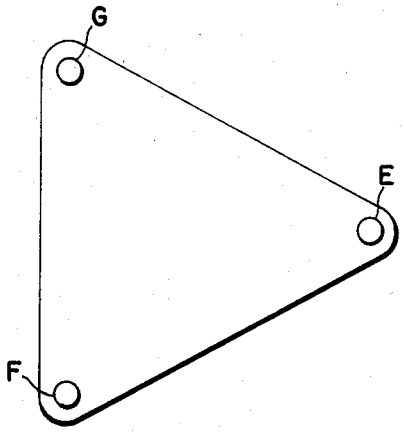
FIGURE 9
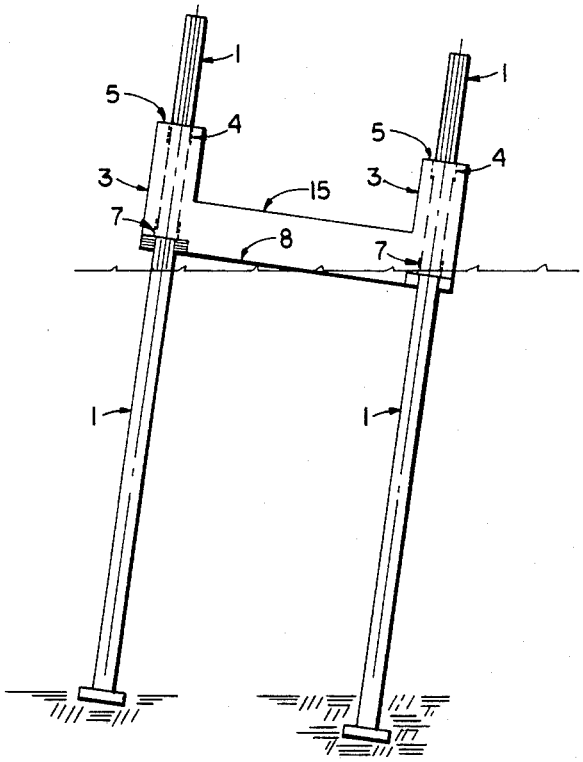
FIGURE 9·A

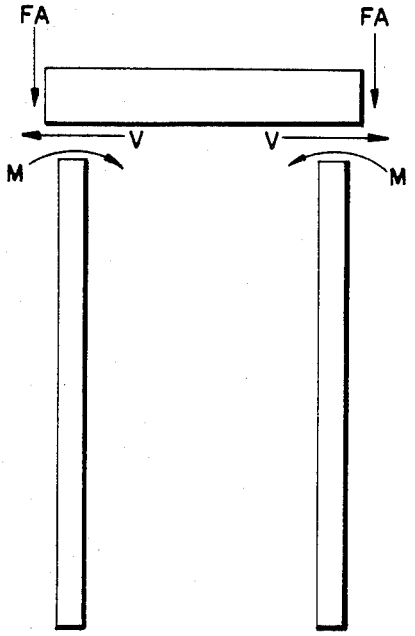
FIGURE 10
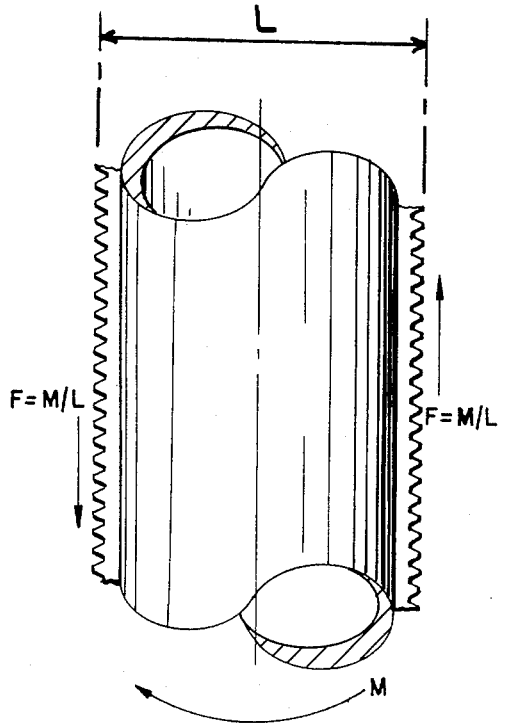
FIGURE 11·B
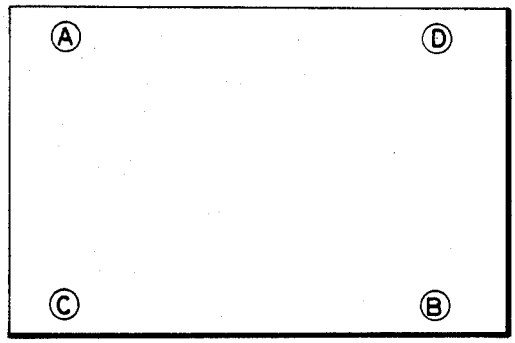
FIGURE 12
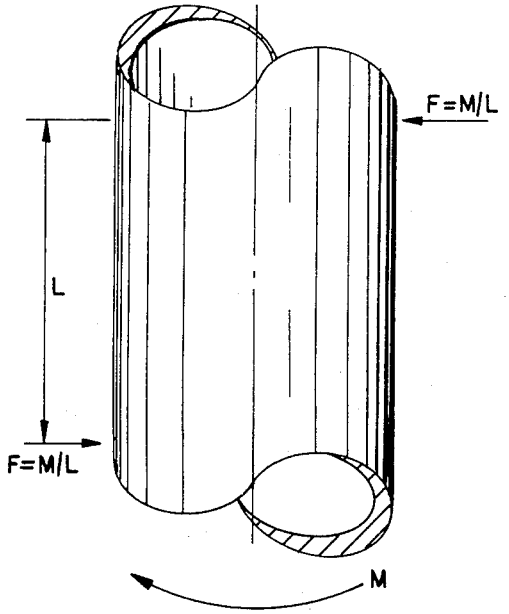
FIGURE 11·A

JACK-UP UNIT

BACKGROUND OF THE INVENTION

The invention described herein relates to mobile "jack-up" drilling and/or service units, and more particularly to a system for protecting the unit's jacking system from additional loading beyond its nominal jacking capacity.

A "jack-up" unit as used herein means any self-elevating platform used for drilling, production, well service, construction or other offshore/inshore purpose. A typical unit consists of a platform structure with attached legs. Said legs are elevated above the platform for movement of the unit from one location to another. Upon reaching the desired location the legs are lowered and upon touching bottom the jacking system, having adequate lifting capacity, raises the platform above the water surface providing a stable working platform. Upon completion of work at the site, the platform is lowered to the water, the legs retracted to the elevated position above the platform, and the unit is moved to the next location.

The present invention was originally conceived as a preload mechanism utilized to limit the maximum loadings on a typical rack and pinion jacking system. However, the present invention is applicable as a means to limit the maximum loadings on any types of jacking systems. In addition, the source of the increased load requirement is not limited to preload application, but may be due to increased variable load while operating, wind and/or wave loadings, and long term soil settlement. The following discussion is directed toward but not limited to the preferred embodiment of the present invention.

The invention described herein, is intended to apply to any jack-up unit with one or more legs and equipped with a jacking system. A jacking system commonly used but not exclusive is the rack and pinion type; however, the system is applicable to any progressively engaging system, be it of rack and pinion or other form.

A "preload" sequence is utilized to reduce the possibility of damage to the unit's legs, platform structure, and/or jacking system as a result of unanticipated soil failure below one or more of the footings. The preload sequence is initiated immediately after the platform is elevated several feet above the crest elevation of any minor wave action on the water surface. As the elevating process is stopped, the axial loadings on the legs are the nominal jacking loads and are transferred from the platform structure through the jacking system to the leg structure and ultimately to the soil below the leg footings.

In anticipation of large wave crest elevations that may occur as a result of storm action while operating, the unit needs to be elevated some twenty-five (25) to fifty (50) feet above the still water elevation before work is commenced. However, the bearing capacity of the soil under the footings is often uncertain, and if a soil failure were to occur with the unit elevated to its large operating "air gap" above the water surface, a catastrophic amount of damage could occur to the unit's platform, leg, and jack structure. Preloading the legs to an axial load value that exceeds any anticipated increase in leg load at a future time while the unit is still near the water surface reduces the possibility of damage and/or minimizes the damage that may occur if soil failure is experienced during the preload sequence. The benefit derived by experiencing any soil failure with a small clearance between platform and water surface can be attributed to the ability of a buoyant hull platform to stop leg penetration into the soil as the hull reenters the water and regains buoyancy before the unit experiences a drastic inclination toward the direction of the leg(s) footing(s) experiencing soil failure.

The additional leg loadings that may occur at a future time are caused by increased variable load desired on the unit during work progress and/or wind and wave overturning moments due to storm conditions that may occur during the work process. A careful review of anticipated increases in deck load due to work requirement as well as an engineering evaluation of increased leg load due to extreme storm overturning moments for the operational area permits the extreme leg loading that will be experienced at any one location to be estimated. Preloading sequences that employ an adequate factor of safety above the maximum estimated leg loadings greatly reduce the possibility of catastrophic soil failure after the unit has been elevated to its normal operating air gap.

Units equipped with independent legs normally require the addition of load to the platform when the platform is elevated to its small preload air gap to effect adequate leg load increases. This is commonly accomplished by pumping readily available water into specially provided ballast tanks in the hull platform. Units with four (4) or more legs may be preloaded by this ballasting sequence or by raising one (1) or more legs in a prescribed sequence to increase the loading on the legs maintaining soil contact without the necessity of adding additional load to the platform. Regardless of which method is used to preload the legs, existing jack-up units require an additional capacity of the active jacking system above that required to elevate the platform in order to effect the required preload value for operation.

To overcome the recognized problems of additional load and soil failure, the invention described herein utilizes a portable large diameter gear or rack section with associated positioning and load transfer mechanisms to protect the active jacking system from the additional leg load applied to achieve required preload value. The preload mechanism system is engaged prior to the ballast transfer on units with three or fewer legs, or is engaged on diagonally opposite legs of a four (4) or more legged system before the legs to be retracted are moved. By this action the maximum loading that is placed on the active jacking system never exceeds the nominal jacking capacity required to elevate the unit, thereby allowing a substantial savings in cost and weight on the jacking units and associated rack attached to the unit's legs. No other prior art system offers this advantage.

PRIOR ART

The combined knowledge of the present inventors and the results of the search done in support of this application indicate a large amount of prior art in this area. The earliest disclosure known to the inventors, with regard to a "jack-up" unit is contained in U.S. Pat. No. 103,899, granted to Samuel Lewis on June 7, 1870. The system consists of a tubular leg with opposed racks of non-involute form, locked in position by four (4) pawl sections which are movable about a fixed point. The pawls are mirror images of the leg rack. The lifting power of the system is provided by two hydraulic (water) cylinders driving a yoke to which two of the pawls are attached thus affecting a lifting load. The unit was described to be used in support of "drilling" operations. This basic concept is still in wide use today and has been modified and disclosed in some related form in the following U.S. Pat. Nos.:

| | |
|---|---|
| 2,862,738 | 3,282,565 |
| 2,954,676 | 3,332,663 |
| 2,979,911 | 3,495,806 |
| 3,109,289 | 3,517,910 |
| 3,171,259 | 3,604,683 |
| 3,201,945 | 3,804,369 |
| 3,290,007 | 4,007,914 |
| 3,245,658 | 4,203,576 |

A practical alternative to the "push-pull" type mechanisms described above normally consists of an involute or similar profile rack attached to the leg, with the lifting load being developed by a rotating "pinion(s)" engaging the leg rack, thus providing continuous motion as the pinions are turned using power transmission equipment. The present invention is of this general form. This concept was first disclosed in U.S. Pat. No. 2,308,743 issued to Bulkley et al. on Jan. 19, 1943. This basic concept is also in wide use today and has been modified and disclosed in some form in the following U.S. Pat. Nos.:

| | |
|---|---|
| 2,924,077 | 3,722,863 |
| 3,014,346 | 3,743,247 |
| 3,044,269 | 4,160,538 |
| 3,183,676 | 4,203,576 |
| 3,343,371 | 4,269,543 |
| 3,606,251 | |

The present invention utilizes a relatively standard active rack and pinion drive similar in form to those listed above. In addition to the active jacking pinions, an additional locking mechanism is utilized to protect the active jacking pinions. The following patents describe some form of multiple tooth locking mechanisms but none are applicable for the intended service of the present invention:

| | |
|---|---|
| 103,899 | 3,343,371 |
| 2,862,738 | 3,722,863 |
| 2,954,676 | 4,269,543 |

In addition, all of the previous patents listed as a "push-pull" type system, inherently require at least a single "tooth" locking device to allow disengagement of the portable lock between power strokes.

The present invention utilizes a relatively standard upper and lower guide to transfer produced leg moments. Previous systems which utilize this concept are shown in the following U.S. Pat. Nos.:

| | |
|---|---|
| 2,308,743 | 3,517,910 |
| 3,171,259 | 3,604,683 |
| 3,109,289 | 3,606,251 |
| 3,201,945 | 3,743,247 |
| 3,282,565 | 4,007,914 |
| 3,290,007 | 4,160,538 |
| 3,495,806 | |

However, none of these systems contain any components capable of protecting the active jacking system, be it "push-pull" or continuous, from application of loads greater than those associated with elevating of the platform.

Systems operating without upper guide structures are common. They require additional active jacking capacity to enable the hull platforms to be re-levelled if soil failure is experienced during preload. The requirement for additional jacking capacity stems from the fact that leg moment must be taken with a vertical force couple rather than a horizontal force couple. As such "passive" overload locks are not applicable as they could not be disengaged after preload soil failure or loads exceeding nominal elevation capacity of the active jacking system. Systems of this type are shown in the following U.S. Pat. Nos.:

| | |
|---|---|
| 2,924,077 | 3,245,658 |
| 3,014,346 | 3,343,371 |
| 3,044,269 | 4,203,576 |
| 3,183,676 | 4,269,543 |

None of the prior art shows or suggests the present invention and are clearly distinguishable from the overall arrangement and capabilities of the preload amplification system described herein.

DISCUSSION OF LOAD PATHS AND PRIOR ART SYSTEMS

Three (3) load components of substantial magnitude are required to be transferred from the platform structure to the leg structure. These are the leg axial load, the leg lateral shear, and the leg beam bending moment. The leg torsion is of minor consequence. These loadings are indicated in FIG. 10 with only two legs shown for clarity.

Leg axial load during jacking is transferred through the jacking system pinions in existing units and the present invention. Leg axial load during preload on existing units is also transferred through the jacking system pinion, necessitating a larger number of pinions with larger teeth and larger pitch diameters, increasing the torque on the gear train and motor systems. The present invention transfers the axial load during preload through the preload gear/rack reducing the design loading on the jacking pinions.

For tubular leg designs the leg lateral shear is transferred through the lower guide into the hull. This statement also substantially applies to existing systems utilizing multiple chord truss leg systems regardless of configuration.

For tubular leg units the leg beam moments are normally transferred through differential lateral forces generated at the upper and lower guides. The magnitude of the force is proportional to the magnitude of the moment and inversely proportional to the vertical spacing between guides. This force couple is depicted in FIG. 11A. The present invention utilizes this transfer mechanism. Another possibility for moment transfer exists in tubular leg systems as a vertical force couple between racks as shown in FIG. 11B. This situation is normally less efficient than the horizontal force couple as the horizontal spacing between the racks is small in comparison to the vertical spacing between the guides. In addition a minimum of three (3) racks on the tubular leg are necessary to generate moment for any azimuth if this method is used.

For truss leg units the leg beam moment is commonly transferred using either the vertical or horizontal force couple or a combination of both couples. Some existing units of the truss leg configuration operate without any upper guide structure of significance. A concise and accurate discussion of load transfer mechanisms for truss leg units may be found in U.S. Pat. No. 4,269,543 and is not repeated here as it has no relation to the present invention, as it can not be utilized for preload application.

DISCUSSION OF SYSTEM RESPONSES TO SOIL FAILURE DURING PRELOAD

Jacking systems and leg and platform structural configurations are normally designed to withstand a moderate amount of load increase due to unit inclination experienced as a result of soil failure during preload. For three (3) legged units the leg axial loadings on the leg(s) experiencing soil failure remains relatively unchanged or is reduced by the acquired hull buoyancy during hull reentry into the water, while the axial load on the other leg(s) remains relatively unchanged. Four (4) legged units having had one pair of legs raised thereby effectively doubling the load on the diagonally opposite legs, and then experiencing soil failure on one of the diagonally opposite legs normally respond in better fashion. The load tends to re-equalize as the leg experiencing soil failure sees a reduction in axial load as the pair of legs intentionally unloaded begin to bear on the soil due to the downward movement of the unit. Substantial inclinations of the unit due to soil failure during preload are of an order of magnitude less common on units with more than three legs than on units with only three legs.

Unlike leg axial load, the magnitude of lateral leg shear and leg beam moment can rise drastically during even minor inclinations experienced during soil failure under preload. This problem is compounded if ballast is being used to preload the unit.

This situation is important to the function of the present invention. The component positioning of the present invention is shown in FIG. 1. The active jacking pinions are deployed as space permits below the upper guide. Immediately below the active jacking pinions are the preload gear/rack and locking mechanisms. The lower guide is well below the preload gear/rack. As additional moment due to soil failure is experienced in the leg, the horizontal force couple in the upper and lower guide increases. The lateral load between preload gear/rack remains relatively unchanged as the preload gear/rack is located near the center of leg rotation. This situation is further enhanced in the present invention by the specification of small tolerances between leg and upper and lower guide and the specification of large backlash between the preload gear/rack and the leg rack.

This combination of component location and tolerance specification results in a negligible "axial" load increase in the preload gear/rack during preload soil failure. This situation assures the capability of the active jacking system to unload the preload gear/rack allowing disengagement and subsequent levelling of the unit platform after soil failure experienced during preload.

Existing units previously cited in the prior art either rely upon active jacking systems or normally double the jacking capacity required for elevating the unit to survive the additional load applied to the unit during leg moment increase experienced during preload soil failure, or rely upon double jacking capacity and upper and lower guide systems to produce the leg axial load required for preload. The present invention is unique in that it requires only the nominal jacking capacity to preload, and at the same time is inherently capable of jacking from an inclined position resulting from soil failure during preload and subsequent increase in leg beam moment.

BRIEF DESCRIPTION OF THE DRAWINGS

FIG. 8 is a view of the jack-up unit of FIG. 6 in an elevated operating position.

FIG. 9 is a schematic top plan view of a typical three legged platform.

FIG. 9A is a side elevational schematic view of the platform of FIG. 9 after experiencing a soil failure during preload testing.

FIG. 10 is a schematic of the relevant forces in a platform of the type shown in FIGS. 6 through 9A.

FIG. 11A is a schematic of a typical leg having beam moment developed by horizontal force couple.

FIG. 11B is a schematic of a typical leg having beam moment developed by vertical force couple.

FIG. 12 is a schematic top plan view of a typical four legged platform.

PREFERRED EMBODIMENT OF THE INVENTION

Figure 1:
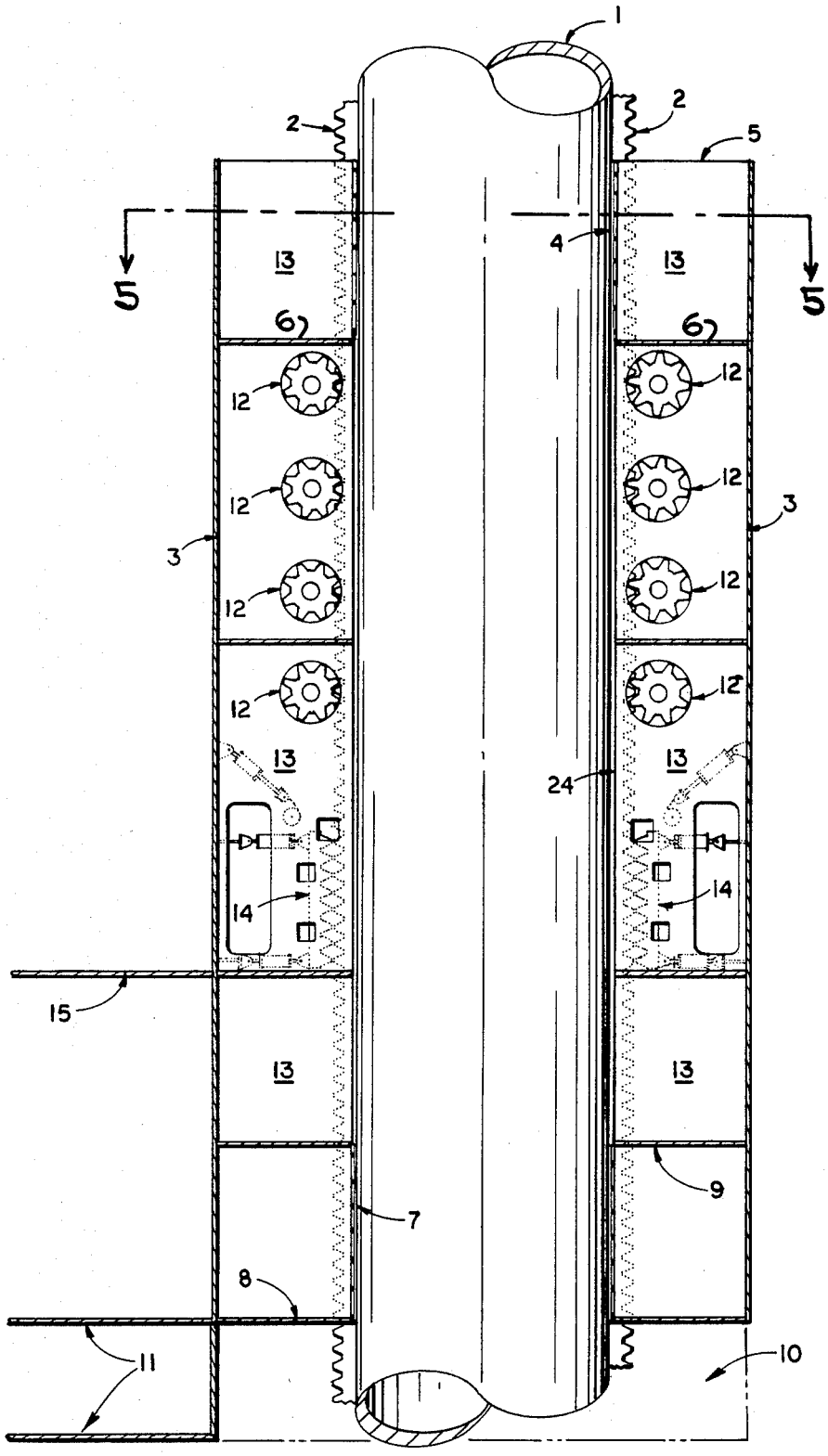
FIG. 1 is a side elevational view with parts shown in solid and dash lines at the hull platform to leg connection area.
Figure 6:
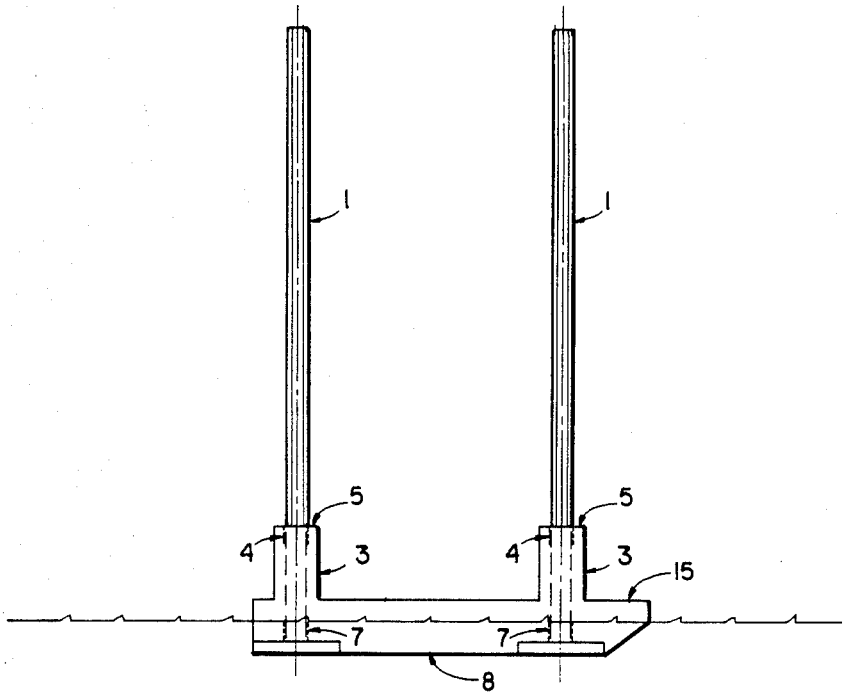
FIG. 6 is a side elevational view of the jack-up unit in the floating position with the support legs fully retracted.
Figure 7:
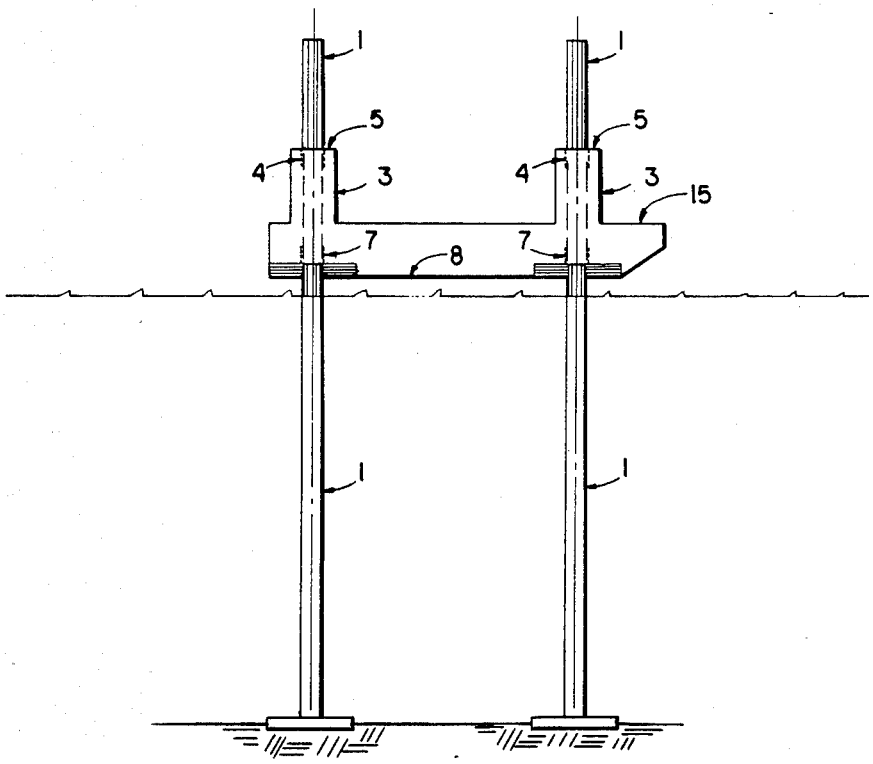
FIG. 7 is a view similar to FIG. 6 with the hull elevated to preload air gap position.

FIG. 1 is an elevation through the hull platform to leg connection area. This section is adjacent to the center of the leg in a plane parallel to the horizontally opposed racks attached to the tubular leg structure. The tubular leg structure 1 and attached rack 2, are enclosed by the jack house bulkheads 3 in the connection region. The close tolerance upper guide tube 4 extends between jack house top 5 and upper guide flat 6. The close tolerance lower guide tube 7 extends between the hull bottom plating 8 and the lower guide flat 9. The jack house structure 24 between close tolerance guides is so proportioned that it does not come in contact with leg tubular shell 1 under any circumstances. The prototype platform has non-coplanar bottom plating to affect a footing retraction recess 10, which is an optional configuration. In this configuration the double bottom plating 11 aligns with the bottom plating 8 in the footing recess 10 to affect lateral load transfer from lower guide tube 7 to hull platform. The active jacking system pinions 12 are mounted between two vertical jack mounting webs 13. The prototype configuration is equipped with eight active jacking pinions per leg. The vertical placement of the pinions 12 is immediately below the upper guide tube 4. The preload gears/racks 14, FIG. 1, and their associated positioning and locking mechanisms are also mounted between the vertical jack mounting webs 13 and are situated immediately below the active jacking pinions 12 and well above the lower guide tube 7. The main or freeboard deck 15, shown in FIGS. 1, 6 and 7, provides access to the positioning and locking mechanisms.

Figure 2:
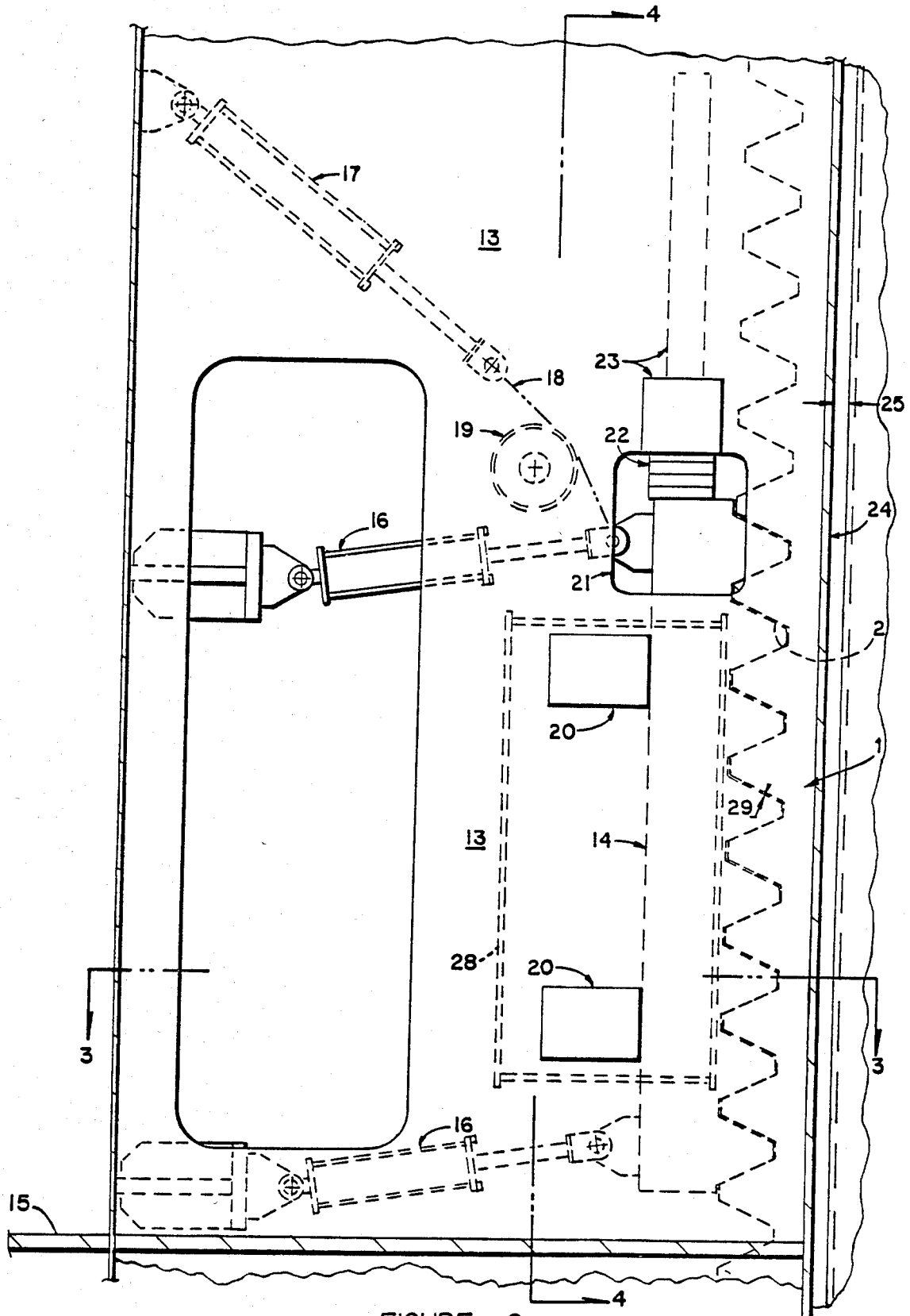
FIG. 2 is a vertical sectional view with parts shown in solid and dash lines taken on the line 2—2 in FIG. 3 taken at an enlarged scale.

FIG. 2 is an enlarged scale elevation of the preload gear/rack 14 and associated positioning and locking mechanisms, shown from the same perspective as FIG. 1. Lateral movement of the preload gear/rack 14 is effected using hydraulic or pneumatic cylinders 16. Vertical positioning of the preload gear/rack 14 is effected by using hydraulic or pneumatic cylinder 17 and an attached cable 18 or similar device passing over the idler sheeve 19. After positioning, locking pins 20 are engaged to prevent lateral movement of the preload gear/racks 14. Shim port 21 is utilized to view the gap between preload gear/racks 14 and shim load structure 23. A proper amount of shims 22 are placed to fill the gap seen in the shim port. The system as shown in FIG. 2 has operating backlash 29 between the preload gear/racks 14 and the leg racks 1. The operating gap between guides 25, is the gap between leg tubular structure 1 and jack house structure 24 in the area not intended to be load bearing.

Figure 3:
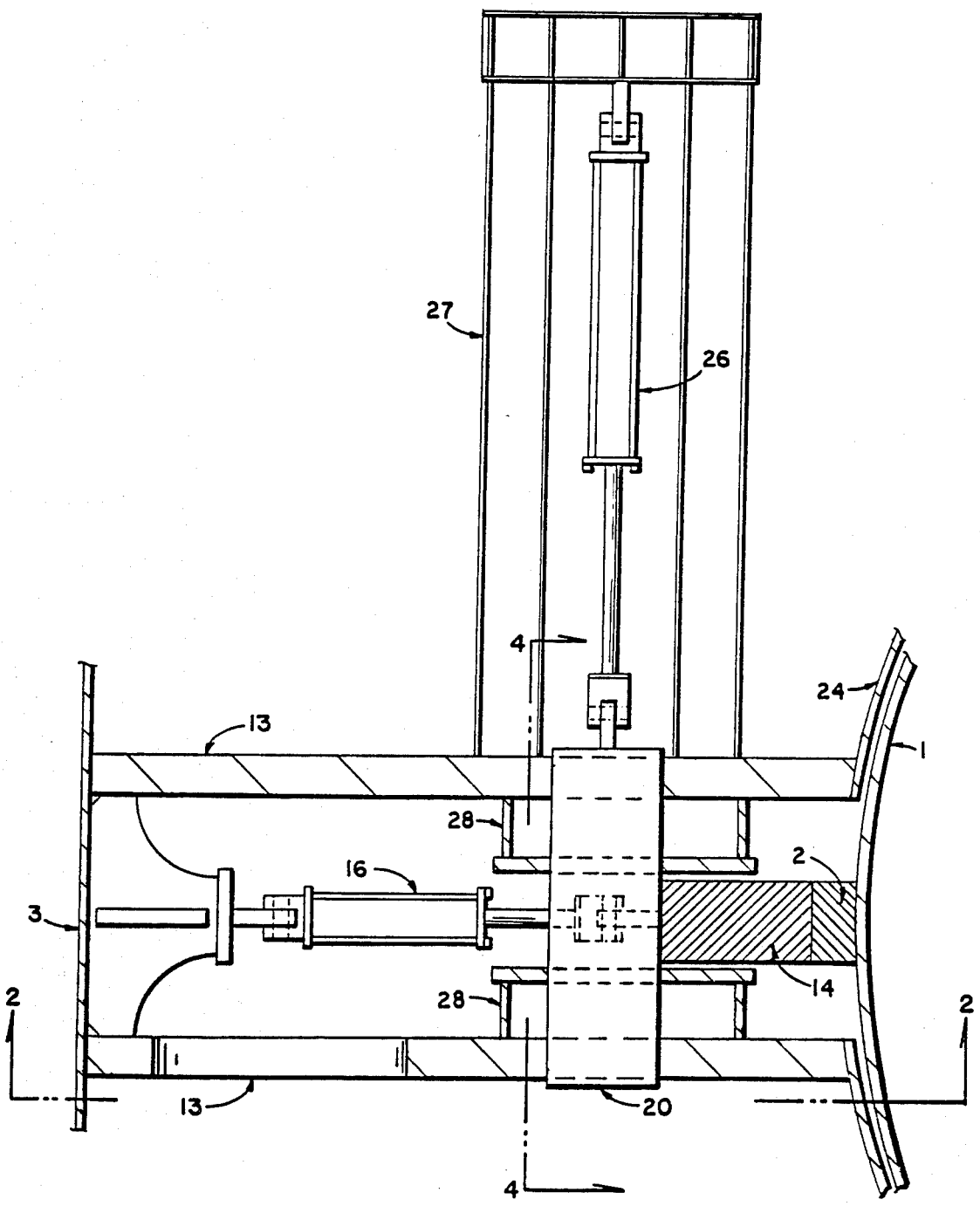
FIG. 3 is a horizontal sectional view taken on the line 3—3 in FIG. 2.

Referring now to FIG. 3 being a horizontal section taken just above the lower lock pin 20, whose plane is indicated on FIG. 2. Lock pin 20 is engaged and disengaged by hydraulic or pneumatic cylinder 26 mounted in pin retractor frame 27. Preload gear/rack guide frames 28 limit the lateral movement of the preload gear/racks 14 normal to their plane of engagement with the leg racks 2. The jack house bulkheads 3, vertical jack mounting webs 13, lower horizontal positioning cylinder 16, preload rack/gear 14, leg rack 2, leg tubular shell 1, and jack house structure 24 are all shown in their respective horizontal plane relationship. The system as shown in FIG. 3 is in the locked position.

Figure 4:
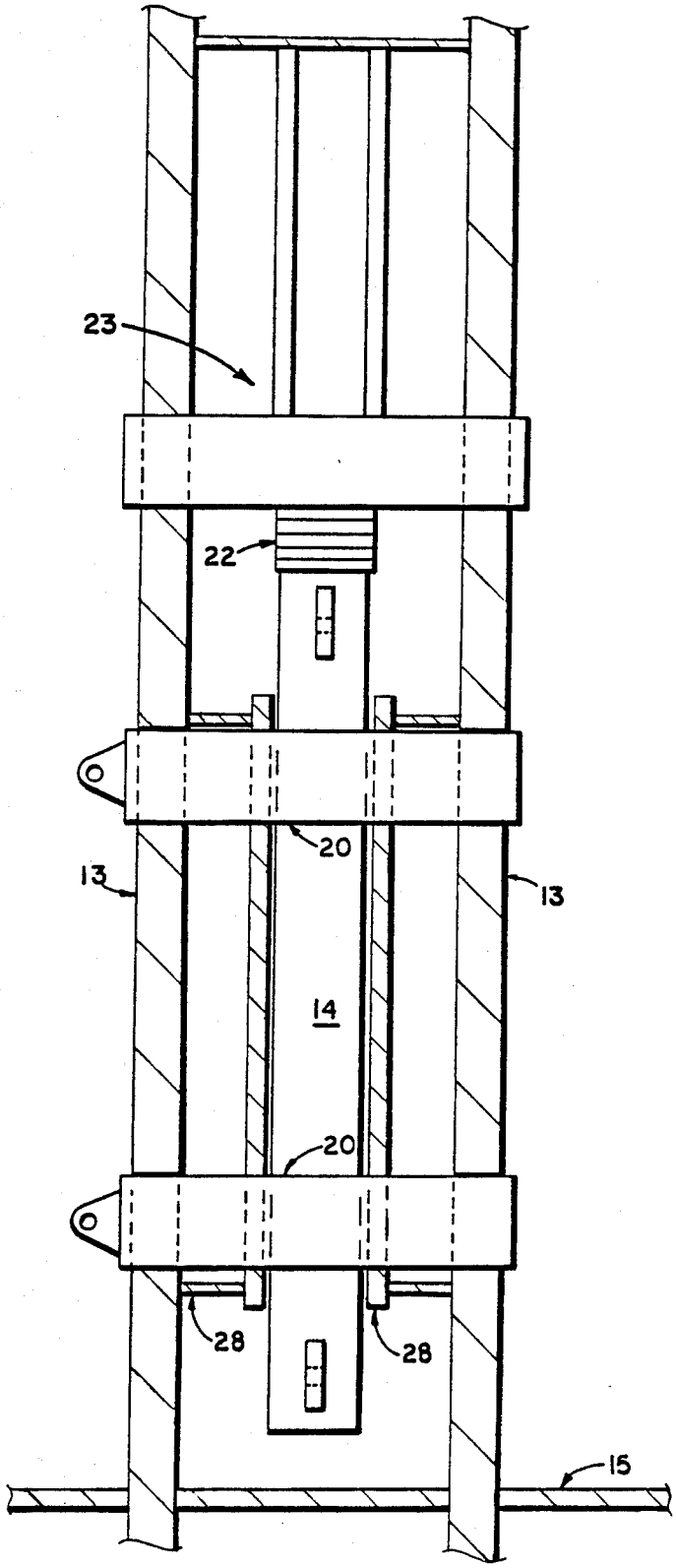
FIG. 4 is a vertical sectional view taken on the line 4—4 in FIG. 2.

FIG. 4 is an elevation through the preload gear/racks in a plane normal to that of.FIGS. 2 and 3. Its plane is indicated in FIG. 2. Shim load structure 23, shims 22 and preload gear/rack 14 are shown in their locked load transfer position. The locking pins 20 are shown engaged. The vertical relationship of the preload gear/rack guide frames 28 to preload gear/racks 14 is clearly indicated. The preload gear/rack frames also provide bearing supports for the locking pins 20. The vertical jack mounting webs 13 are shown to enclose the lock mechanisms in FIG. 4.

Figure 5:
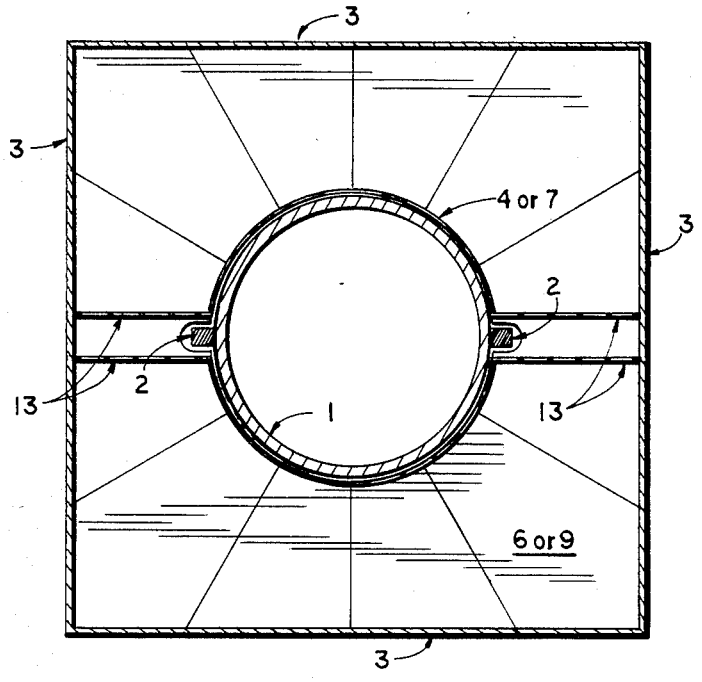
FIG. 5 is a horizontal sectional view taken on the line 5—5 in FIG. 1.

FIG. 5 is a horizontal sectional view taken through either the upper or lower close tolerance guide tubes 4 or 7, tubular leg structure 1, leg rack 2, vertical jack mount webs 13, and guide flat 6 or 9 are shown in their respective positions in the horizontal plane in FIG. 5.

MODE OF OPERATION OF THE PREFERRED EMBODIMENT

During transit from one location to another the legs are in their fully retracted position and the hull platform to leg configuration would be as shown in FIG. 6. In this situation, the weight of the legs is supported on the active jacking pinions 12. Any shear loading in the leg is transmitted to the hull structure through the upper close tolerance guide tubes 4, jack house top 5, upper guide flat 6, and jack house bulkheads 3. Any beam bending moment in the legs 1 due to platform motion and/or wind loading on the legs is transferred through the upper close tolerance guide tube 4 and the lower close tolerance guide tube 7 in the form of a horizontal force couple as shown in FIG. 11A. Load transfer from the guide tubes 4 and 7 to the hull is through the guide flats 6 and 9, and jack house top 5 and bottom plating 8. In this condition the preload gear/racks 14 if engaged, incur no loading due to leg beam moment as the backlash 29 between preload gear/racks 14 and leg rack 2, shown in FIG. 2, exceeds by a substantial margin, the tolerance between upper and lower guide tubes 4 and 7 and the leg tubular structure 1. Also in this configuration the active jacking pinions 12 are not subjected to additional loading as they are also operated with a backlash that far exceeds the guide tube to leg tolerance.

Upon reaching location the legs 1 are lowered using the active jacking pinions until the footings contact the sea floor. The downward jacking of the legs 1 is continued, lifting the hull platform from the water, until the bottom of the hull platform has been elevated to a distance of several feet above the maximum elevation of any wave action on the water surface. This condition is shown in FIG. 7. The loading being held by the active jacking pinions 12 in this condition are the nominal jacking loads for each leg, a function of the weight value and distribution of the hull platform structure, outfitting, machinery, and consumables aboard at the time of jacking.

The preload sequence is initiated, as best seen in FIG. 2, by engaging the appropriate preload gear/racks 14. The engaging process starts by adjusting the elevation of preload gear/racks 14 using cylinder 17 attached to preload gear/racks 14 by cable 18 strung over idler sheeve 19. The position of preload gear/racks 14 relative to leg rack 2, is observed through shim port 21. After mating elevation is achieved between preload gear/racks 14 and leg rack 2, cylinders 16 are utilized to move preload gear/racks 14 laterally into engagement with leg rack 2. Cylinders 26 are used to move the locking pins 20 into position behind preload gear/racks 14. Any substantial gap between the preload gear/racks 14 and shim load structure 23 is filled with an appropriate number of shims 22. The active jacking pinion braking system is then released allowing the nominal jacking load to be transferred from the leg rack 2 to the preload gear/racks 14 through shims 22, into shim load structures 23 and ultimately into jack mounting webs 13. The horizontal load produced in gear/racks 14 is transferred through lock pins 20 into jack mounting web 13.

The number and choice of legs on which the preload gear/racks would be engaged depends on unit configuration. The four legged platform as shown in FIG. 12 will be discussed first.

For the four legged unit, if the platform had been elevated to preload air gap as shown in FIG. 7 and the preload gear/rack mechanisms had been engaged as previously discussed on legs lettered A and B in FIG. 12. At this point the individual leg loading will be the same nominal jacking value having been necessary to raise the unit to the preload air gap. To achieve preload on legs A and B (FIG. 12) one or both of legs C and D (FIG. 12) are raised a small amount thereby incrementally increasing the load on legs A and B locked in position by the preload gear/racks 14, to the desired value. Any moment imbalance about a horizontal axis passing through legs A and B due to the center of gravity of the unit being "off the diagonal" will result in a small remaining load on either leg C or D as position of the center of gravity would dictate. At this time, the loading on the active jacking pinions 12 on legs C and D will be minimal. The active jacking pinion load on legs A and B will approach zero as the brakes are released. The vast marjoity of the platform load is applied to legs A and B through their respective preload gear/racks 14. As such, preload has been affected without requiring that the active jacking pinions 12 transfer the load between the leg and hull. Also the teeth of the leg rack 2 are not experiencing a load greater than they experience during jacking as a minimum of double the number of teeth are engaged on preload gear/racks 14 as there are engaged teeth on the active jacking pinions 12 on the same leg rack 2. In addition, the tooth loadings on the leg rack 2 and preload gear/racks 12 are near midtooth, as opposed to intermittent tooth "tip loading" experienced by leg rack 2 when active jacking pinions 12 are engaging leg rack 2. This further reduces the leg rack 2 tooth bending stresses well below those values experienced during jacking.

To continue the preload sequence, the preload value is held on legs A and B for a period of time to determine that the soil will hold the load. After the operator determines that the soil below legs A and B had adequate bearing capacity, the active jacking pinions 12 on legs C and D are utilized to lower legs C and D back to their preload air gap positions where they once again regain their nominal jacking load value. This completed, active jacking pinions 12 on legs A and B are used to jack legs A and B downward slightly. At this time the active jacking pinions 12 on legs A and B have regained their nominal jacking load. Preload gear/racks 14 on legs A and B are engaged, but not supporting any load.

Following the sequence to reestablish the nominal jacking loads on active jacking pinions 12 the preload gear/racks on legs A and B are disengaged in reverse order of the sequence used to engage the locking mechanisms. This would require removing shims 22, retracting locking pins 20 using cylinders 27, and retracting preload gear/racks 14 using cylinders 16.

To complete the preload sequence it is necessary to apply the required preload value to legs C and D. This operation would follow the same sequence previously discussed with the preload gear/racks 14 engaged on legs C and D, leg(s) A and/or B retracted slightly to apply additional load to legs C and D, downward jacking of legs A and B to reequalize leg loading, and finally disengaging preload gear/racks 14 on legs C and D.

Having completed the preload sequence, the unit can be safely elevated to its normal operating air gap value as shown in FIG. 8.

The preload sequence on units with more than four legs would be similar to the previous discussions on four legged units with the exception that the number and position of legs locked and retracted to affect preload would vary with unit configuration. The preload sequence on three legged units is distinct in that leg positioning has very little if any effect on leg axial load and would normally require introduction of some external source of weight such as ballast water.

After the three legged unit has been elevated to preload air gap position similar to FIG. 7, the preload gear/racks 14 of the present invention would be engaged on one leg only, suppose leg E of FIG. 9.

At this time ballast would be pumped into especially provided preload tanks located in the upper hull platform in the immediate vicinity of leg E of FIG. 9. This would continue until the leg axial load on leg E reached the desired preload value, assuring the operator of safe soil condition under leg E. After preloading leg E, the ballast pumped into the preload tanks would be discharged. This process would be repeated in turn on legs F and G of FIG. 9 until all legs had been checked for adequate soil bearing capacity, after which the unit would be jacked to the required operational air gap.

The response of the present invention to preload induced soil failure differs substantially from that of the prior art units. Consider two units, one equipped as the present invention, and the other one equipped with a prior art system similar to those described by U.S. Pat. Nos. 3,343,371 or 4,269,543 were at preload air gap with ballast applied at leg E of FIG. 9. The unit of the present invention would be retaining preload on the preload gear/racks 14 thereby protecting the active jacking pinions 12 from the preload. If the lock devices of the prior art systems were engaged, a similar situation would exist. Now if both units experience soil failure below leg G of FIG. 9, resulting in a substantial list of the platform as shown in FIG. 9A, the leg beam bending moments in both units would increase substantially. Often in practice a value of three (3) times maximum storm loading leg beam moment is attained. The vertical loading on the gear/racks 14 of the present invention would remain virtually unchanged or would be reduced by hull platform buoyancy. The required leg beam moment for unit equilibrium would be produced by a horizontal force couple similar to FIG. 11A. The vertical loading on the locking mechanisms of the prior art unit could increase by a factor of three on the "down load" side and would reverse on the "up load" side. This situation would require the jacking system on the prior art units to be designed to accommodate the "down side" load to enable the locking mechanisms to be released by jacking the load off the lock mechanisms. Since this design requirement negates any beneficial effect of using the locking device for preloading the prior art systems, it is not practical to use the prior art locking devices to protect the active jacking systems from preload "overload" values. A similar but less frequent occurrence could occur with a four legged unit, but two adjacent legs would have to experience soil failure simultaneously for the unit to experience a substantial inclination during preload operations.

The net effect of using the preload gear/racks 14 in the manner described above has been to reduce the ultimate load capacity requirement for leg rack 2 and jacking pinions 12 with associated drive train components by a factor of at least 50%, thereby reducing overall system costs substantially. The saving of total weight in leg rack 2 has other important advantages to the total unit design. Lighter leg rack 2 produces lower leg bending moments in transit position due to reduced inertial loading caused by hull platform motion when in transit (FIG. 6). This fact allows a reduction of the lower leg strength requirement thereby giving additional savings. Reduced leg structure 1 weight and leg rack 2 weight produce a marked improvement in the floating stability of the hull platform in transit condition (FIG. 6). This advantage allows the utilization of a smaller hull platform for a given leg length and water depth capability and an increase in variable load carrying capacity in the form of additional consumables. On the other hand, a given hull platform may be equipped with longer legs 1 thereby increasing the maximum water depth capability without incurring additional costs for hull platform construction. Additionally, in the configuration of four or more legs, by using the method of preload described in FIG. 12 by which diagonally opposite legs are loaded incrementally by raising their counter parts, the necessity for additional platform ballast tanks is reduced, thereby further reducing the cost of hull platform construction.

What we claim is:

1. A Jack-Up Unit for use in a body of water, comprising:

a floatable hull;

a plurality of legs, said legs suitable for contacting a solid surface and for supporting said hull in an elevated position relative to the surface of said body of water, each of said legs including at least one longitudinally extending leg gear rack;

means for moving said hull longitudinally relative to said legs for establishing said hull at a desired height relative to said legs;

a guidance system on each leg for said moving means, comprising, an upper guide member configured to surround said leg at a close tolerance interval, and a lower guide member configured to surround said leg at a close tolerance interval; and a plurality of gear rack sections located one proximate each leg intermediate said upper guide member and said lower guide member, each gear rack section movable into and out of toothed engagement with said leg gear rack section on its respective leg, said toothed engagement including a gear tooth backlash in excess of said close tolerance between said upper and lower guide members and said leg whereby said engagement of said gear rack section and said leg gear rack is vertically load bearing yet horizontally pliable.

2. The Jack-Up Unit of claim 1, wherein said upper and lower guide members are rigidly secured to said hull and act as horizontal force couplers between said legs and said hull.

3. The Jack-Up Unit of claim 2, wherein each of said legs is of a generally cylindrical form and wherein each leg includes at least two of said longitudinally extending leg gear racks.

4. The Jack-Up Unit of claim 3, wherein said gear racks are generally equi-distantly spaced from one another around each of said legs.

5. A jack-up unit for use within an offshore water environment, comprising:

a floatable hull;

a plurality of legs, said legs being suitable for supporting said hull in an elevated position relative to the surface of said water;

means for moving said hull relative to said legs for establishing said hull at a desired height relative to said legs;

means for securing said hull in generally fixed vertical relation to said legs while limiting vertical loading on said moving means, said securing means including a plurality of gear rack sections secured to said hull, at least one gear rack section proximate each of said legs, each of said gear rack sections movable into and out of toothed engagement with the leg gear rack on such leg; and means for transferring lateral leg shear forces and lateral leg bending moments to said hull, aaid means for transferring lateral leg shear forces and lateral leg bending moments to said hull including a plurality of upper guide members, one proximate each of said legs, each of said upper guide members figurative to surround its respective leg at a given tolerance, a plurality of lower guide members, one proximate each of said legs, each of said lower guide members configurative to surround its respective leg at a given tolerance, said lower guide member situated relative to said leg such that the gear rack section proximate that leg is engageable with said leg at a location intermediate said upper guide member and said lower guide member, and a large backlash maximum toothed engagement between each of said gear rack sections and their adjacent leg gear rack, said large backlash allowing lateral movement of said leg gear rack relative to said gear rack section, said large backlash comprising a backlash in excess of said tolerance between said upper guide member and such leg and said tolerance between said lower guide member and such leg.

* * * * *